US007573358B2

(12) United States Patent
Gevorgian et al.

(10) Patent No.: US 7,573,358 B2
(45) Date of Patent: Aug. 11, 2009

(54) TUNABLE MICROWAVE ARRANGEMENTS

(75) Inventors: Spartak Gevorgian, Gothenburg (SE); Thomas Lewin, Onsala (SE); Dan Kuylenstierna, Göteborg (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 56 days.

(21) Appl. No.: 10/596,687

(22) PCT Filed: Dec. 30, 2003

(86) PCT No.: PCT/SE03/02091

§ 371 (c)(1),
(2), (4) Date: Apr. 7, 2007

(87) PCT Pub. No.: WO2005/064737

PCT Pub. Date: Jul. 14, 2005

(65) Prior Publication Data

US 2007/0262830 A1 Nov. 15, 2007

(51) Int. Cl.
*H01P 7/08* (2006.01)
*H01P 3/08* (2006.01)

(52) U.S. Cl. ..... 333/235; 333/219; 333/246

(58) Field of Classification Search ..... 333/219, 333/235, 205, 99 S

See application file for complete search history.

(56) References Cited

U.S. PATENT DOCUMENTS

| | | | | |
|---|---|---|---|---|
| 5,389,943 | A * | 2/1995 | Brommer et al. | 343/909 |
| 6,563,153 | B2 * | 5/2003 | Wikborg et al. | 257/295 |
| 6,563,404 | B2 * | 5/2003 | Fiedziuszko et al. | 333/205 |
| 6,747,357 | B2 * | 6/2004 | Lee et al. | 257/760 |
| 7,030,463 | B1 * | 4/2006 | Subramanyam et al. | 257/595 |
| 7,145,412 | B2 * | 12/2006 | Hunt et al. | 333/24 R |
| 2002/0187902 | A1 * | 12/2002 | Kai et al. | 505/100 |
| 2006/0061438 | A1 * | 3/2006 | Toncich | 333/205 |
| 2007/0024400 | A1 * | 2/2007 | Subramanyam et al. | 333/205 |

* cited by examiner

*Primary Examiner*—Benny Lee
*Assistant Examiner*—Gerald Stevens
(74) *Attorney, Agent, or Firm*—Potomac Patent Group PLLC

(57) ABSTRACT

The present invention relates to a tunable microwave arrangement (10) comprising a microwave/integrated circuit device (11) and a substrate (6). It comprises a layered structure disposed between said microwave/integrated circuit device and said substrate (5), said layered structure acting as a ground plane and it comprises at least one regularly or irregularly patterned first metal layer (1), at least one second metal layer (3), at least one tunable ferroelectric film layer (2), whereby said layers are so arranged that the ferroelectric film layers) (2) is/are provided between the/a first metal layer (1) and the/a second metal layer (3).

24 Claims, 5 Drawing Sheets

TUNABLE MICROWAVE ARRANGEMENTS

This application is a U.S. national stage application of International Application No. PCT/SE2003/002091.

FIELD OF THE INVENTION

The present invention relates to a tunable microwave arrangement comprising a microwave/integrated circuit device and a substrate. The invention also relates to a method for tuning such a microwave arrangement.

STATE OF THE ART

In advanced microwave communications systems the requirements on components are getting higher and higher e.g. as far as performance and functionality are concerned. For the functionality reconfigurability, flexibility and adaptability are important issues. Fabrication costs are also critical issues. Another important factor is the need to be able to make various microwave components as small as possible.

Therefore a large effort is put on finding new and better materials for the making of the components. Another critical issue concerns design methods and much investigation is done to refine existing methods and to establish new, improved design methods. Recently Electromagnetic Band-Gap (EBG) crystals, also denoted photonic bandgap crystals, have been proposed for the design of microwave devices and microwave systems, particularly for the purposes of providing improved performance. This is e.g. discussed in "PBG Evaluation for Base Station Antennas", in $24^{th}$ ESTEC Antenna Workshop on Innovative Periodic Antennas. Photonic Bandgap, Fractal and Frequency Selective structures (WPP-185), pages 5-10, 2001.

It has also e.g. in "Beam steering microwave refector based on elecrically tunable impedance surfaces", by D. Sievenpiper, I. Schaffner, Electronics Letters, Vol. 38, no. 21, pages 1237-1238, 2002 been demonstrated that microstrip devices with EBG frequency sective surfacer offer improved performances as far as the suppression of surface waves is concerned. In this same document it is pointed at the possibility of tuning EBG crystals using semiconductor varactors. However, it is actually not possible to use such types of tunable EBG crystals as ground planes for several reasons. One reason is that the use of semiconductor diodes makes the design expensive.

Another reason is that the sizes of the EBG crystals are comparable to the wavelenght of the microwaves, which makes it impossible to use them as groundplanes in some microwave devices (e.g. microstrip filters). Still further the tuning DC voltage is applied to the top microstrip circuit.

The supply of the tuning DC-voltage however requires decoupling circuits to prevent the microwaves from going into the DC supply. It must be possible to permit the DC supply to be delivered to the microwave component (e.g. microstrip). Such decoupling circuits however make the entire microwave device/circuit complicated. Moreover, sometimes they require high voltages which may make the device dangerous, and other components may be vulnerable to such high voltages.

One way to overcome the problems associated with decoupling circuits might be to move controlled components from the top surface to the bottom surface of the device. This may however be complicated and inconvenient for several applications.

SUMMARY OF THE INVENTION

What is needed is therefore a microwave arrangement as initially refered to which has a high performance and which is flexible. Still further a microwave arrangement is needed which is cheap and easy to design and fabricate. Further yet a microwave arrangement is needed which is adaptable and reconfigurable. Particularly an arrangement is needed which is tunable without requiring much, or any at all, complicated and risky decoupling circuits requiring high voltages. Even more particularly a microwave arrangement is needed through which advantage can be taken of e.g. Electromagnetic Bandgap crystals as ground planes without requiring high voltage decoupling circuits. Microwave arrangements are also needed which are small sized, easy to tune and which can be used for high frequency (GHz and above that) applications, e.g. within modern microwave communication systems and radar systems, among others. A method for tuning such an arrangement is also needed.

Therefore a microwave arrangement as initially referred to is provided which comprises a layered structure disposed between said microwave/integrated circuit device and said substrate, which layered structure acts as a ground plane. It comprises at least one regularly or irregularly patterned first metal layer, at least one second metal layer and at least one tunable ferroelectric film layer. The layers are so arranged that the/a ferroelectric film layer is/are provided between the/a first metal layer and the/a second metal layer.

Preferably the patterned first metal layer(s) comprise(s) (a) patterned Elecromagnetic Bandgap crystal structure. The ferroelctric film layer(s) may be patterned in some implementations. However, in other implementations the ferroelectric film layer(s) is/are homogeneous, i.e not patterned.

The second metal layer(s) may be homogeneous, i.e not patterned, but it may also be patterned. It may then be differently patterned than the ferroelectric layer (if patterned) or in the same manner. It may also be differently or similarly patterned as compared to the first metal layer. By patterned is in this application meant any regular or irregular patterning. It may comprise stripes, squares (one or more), rectangles, ovals, circular patterns or anything.

The second metal layer(s) particularly comprise(s) Pt, Cu, Ag, Au or any other appropriate metal.

The ferroelectric film layer may comprise $SrTiO_3$, $Ba_x Sr_{1-x} TiO_3$ or a material with similar properties.

The ground plane structure is tunable, and for tuning a DC voltage is applied between the/a first metal layer and the/a second metal layer. If there are more first and second layers, i.e. a multilayer structure, any appropriate first and second layers may be selected for tuning purposes.

Tuning of the microwave/integrated circuit device is achieved through the tuning of the ground plane, particularly without requiring any decoupling circuits on the device at all.

Through the application of the DC biasing (tuning) voltage, the dielectric constant of the ferroelectric film is affected, changing the impedance of the ground plane surface adjacent the microwave/integrated circuit device, thus tuning the device or component arranged on the ground plane, preferably with a dielectricum (e.g of BCB) disposed therebetween.

The microwave circuit may comprise a microstrip line or coupled microstrip lines. It may also comprise a patch resonator (of any appropriate shape, square, circular, rectangular etc.). In another embodiment the microwave circuit comprises an inductor coil. It may also generally comprise a microwave transmission line, or e.g. a coplanar strip line device.

As can be seen, the microwave/integrated circuit device may in principle comprise any component, e.g. a semiconductor IC, parts of filters, e.g. bandpass or bandreject filters etc.

The substrate may comprise a semiconductor, e.g. Si, a dielectricum, a metal or any material with similar properties.

As referred to above, between the microwave device and the (top) patterned first metal layer a low permittivity, low loss dielectricum is preferably provided, which comprises a BCB or any other polymer. Preferably the applied tuning voltage is lower than 100 V, even more particularly lower than about 10 V, e.g. 5 V.

The ferroelectric layer may have a thickness of about 0.1-2 μm. Particularly the ground plane structure comprises a multilayer structure with more than one ferroelectric layer, each ferroelectric layer being disposed between a first and a second/a first metal layer.

The invention also proposes a method for tuning a microwave arrangement comprising a microwave/integrated circuit device and a substrate. The microwave arrangement further comprises a layered structure acting as a ground plane for the arrangement and being disposed between the microwave/integrated circuit device and the substrate, the method comprising the step of; applying a DC tuning voltage between a first patterned metal layer and a second metal layer disposed on opposite sides of a ferroelectric layer, which layers constitute the ground plane of the arrangement.

Preferably the patterned first metal layer(s) comprise(s) a patterned Electromagnetic Bandgap crystal structure.

For tuning the microwave/integrated circuit device, the step of applying a DC voltage influences the impedance on top of the ground plane, thus changing the resonant frequency of the microwave/integrated circuit device.

The method particularly further comprises the step of, in a multilayered ground plane structure comprising more than two ferroelectric film layers; selecting any of the first and second metal layers surrounding any of the ferroelectric films for tuning the microwave/integrated circuit device.

BRIEF DESCRIPTION OF THE DRAWINGS

The invention will in the following be further described, in a non-limiting manner, and with reference to the accompanying drawings, in which.

DETAILED DESCRIPTION OF THE INVENTION

Figure 1:
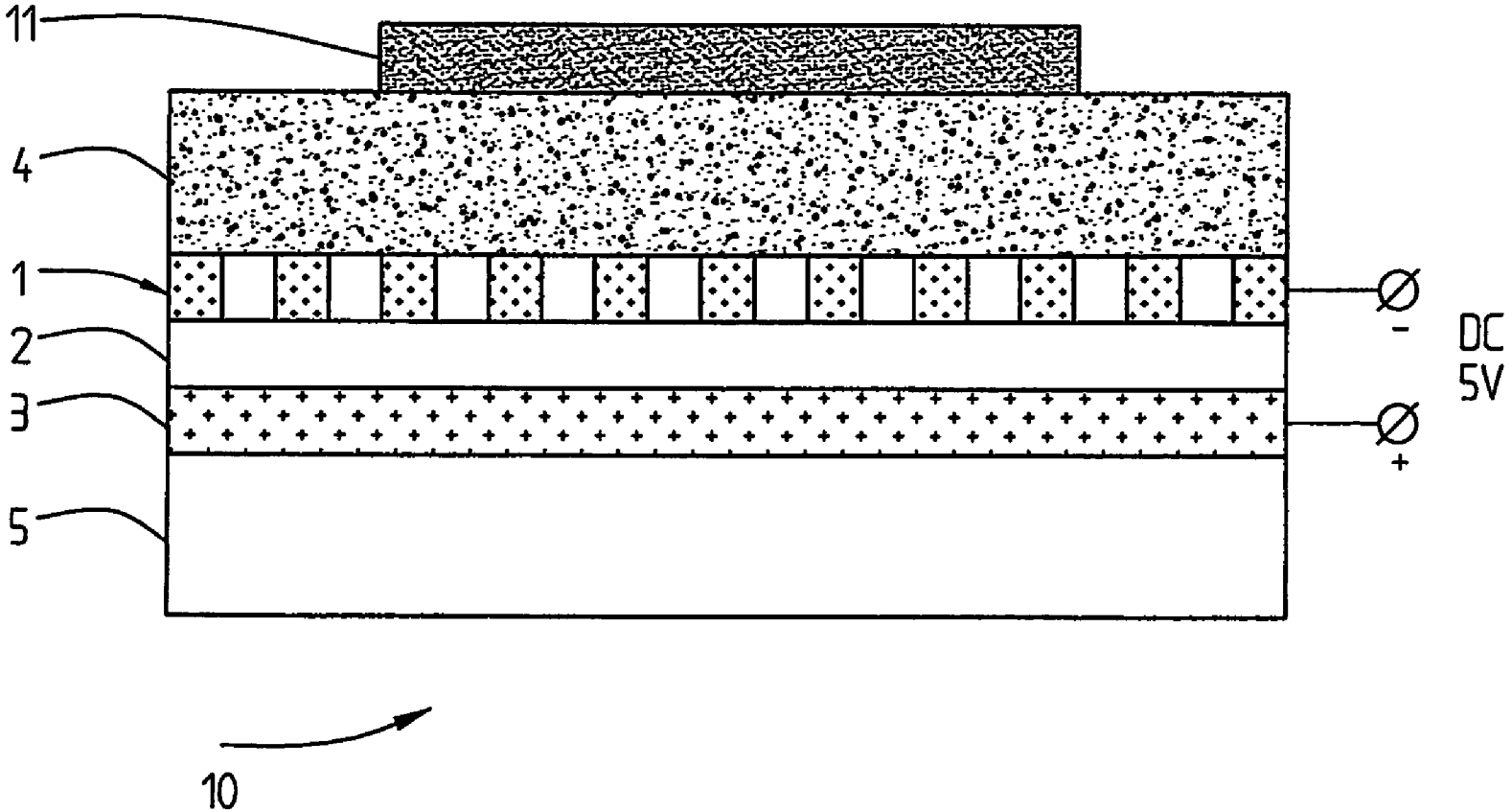
FIG. 1 is a cross-sectional view of a microwave arrangement with a tunable EBG ground plane.

FIG. 1 shows a microwave arrangement 10 according to one embodiment of the invention. The microwave arrangement 10 comprises a microwave device 11 here comprising e.g. a patch resonator and a substrate 5 e.g. of Si. A layered structure forming a ground plane is disposed on the substrate 5 and it comprises a first metal layer 1, here comprising an EBG patterned on top of a ferroelectric film layer 2 which is tunable.

Ferroelectric films have been proposed for microwave applications in U.S. Pat. No. 6,187,717. In this document it is established that ferroelectrics having a large dielectric constant enable a substantial reduction in size and the DC voltage dependence of the permittivity. This makes ferroelectric materials extremely advantageous for applications where it is desirable to have small sized tunable microwave devices. This document is herewith incorporated herein by reference.

The ferroelectric film layer 2 may e.g. comprise $SrTiO_3$, $Ba_x Sr_{1-x} TiO_3$ or any other material with similar properties. The ferroelectric film is disposed on a second metal layer 3, here e.g. comprising Pt (or Cu, Au, Ag etc). The first metal layer 1 is patterned. It may be regularly patterned or irregularly patterned. In this implementation it is regularly patterned to form stripes with a pitch of e.g. $\lambda g/2$ (the wavelength in the medium) or smaller than that. Preferably it comprises 2D EBG material.

The ferroelectric film layer 2 shown in this embodiment is not patterned. It may however also be patterned, in the same manner as the first metal layer 1, or in any other manner. The patch resonator 11 (or any other passive microwave component) is separated from the EBG surface (i.e. the top surface of the first, patterned metal layer 1) through a low permittivity, low loss dielectricum 4, e.g. of BCB or any other polymer (or any other material with similar properties).

For tuning of the microwave component (here patch resonator 11) a tuning voltage (of less than 100 V, preferably less than 10, e.g. 5 V) is applied between the first metal layer 1 and the second metal layer 3 (the ground plane). Tuning the impedance of the EBG ground plane will change the resonant frequency of the patch resonator 11.

The design may e.g. be integral with a Si IC circuit, and it is useful among others for high frequencies, e.g. up to and above about 20 GHz.

It should be noted that the microwave device (here patch resonator 11) is not DC biased, but instead the first and second metal layers where the tuning of the surface of the ground plane is achieved, and hence of the resonant frequency.

Figure 2:
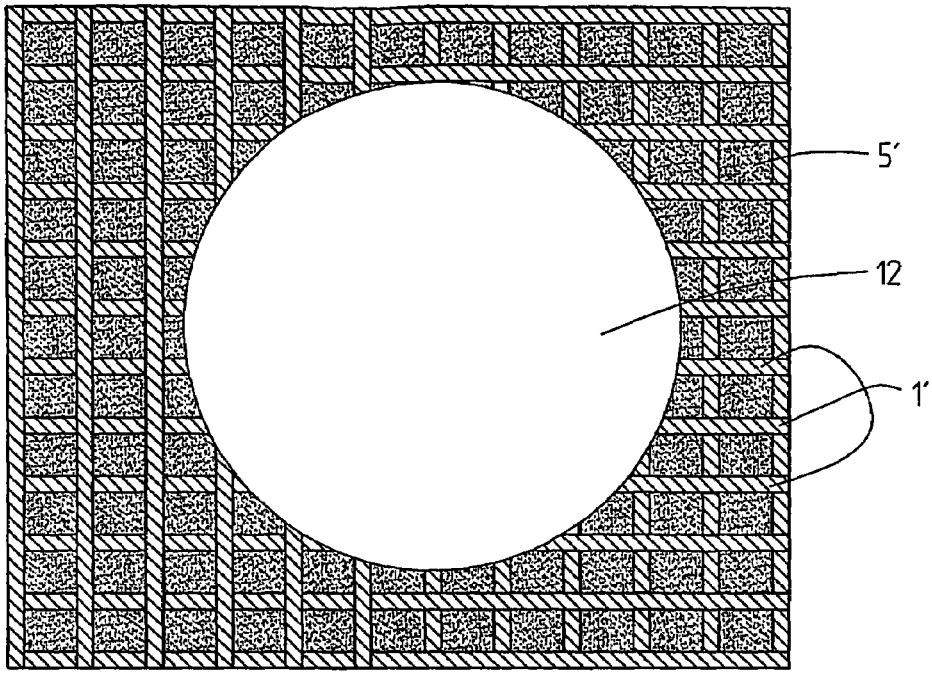
FIG. 2 is a plan view of another embodiment according to the invention in which the microwave device comprises a circular patch reonator.

FIG. 2 shows an arrangement 20, quite similar to that of FIG. 1 in a plan view, from above. It discloses a microwave device 12 comprising a circular patch resonator on top of a dielectric layer e.g. of BCB (not shown in the Figure). The dielectric layer is disposed on a first metal layer 1' comprising a 2D EBG patterned crystal layer and it here comprises orthogonal strips. The ferroelectric film layer on which the first metal layer is disposed is not visible in the Figure, neither is the second metal layer. However, the structure substantially corresponds to that of FIG. 1. The ground plane is disposed on substrate layer 5', e.g. of Si. It should be clear that the patch resonator does not have to be circular, on the contrary it might have any appropriate shape, there might be more than one patch etc.

Figure 3:
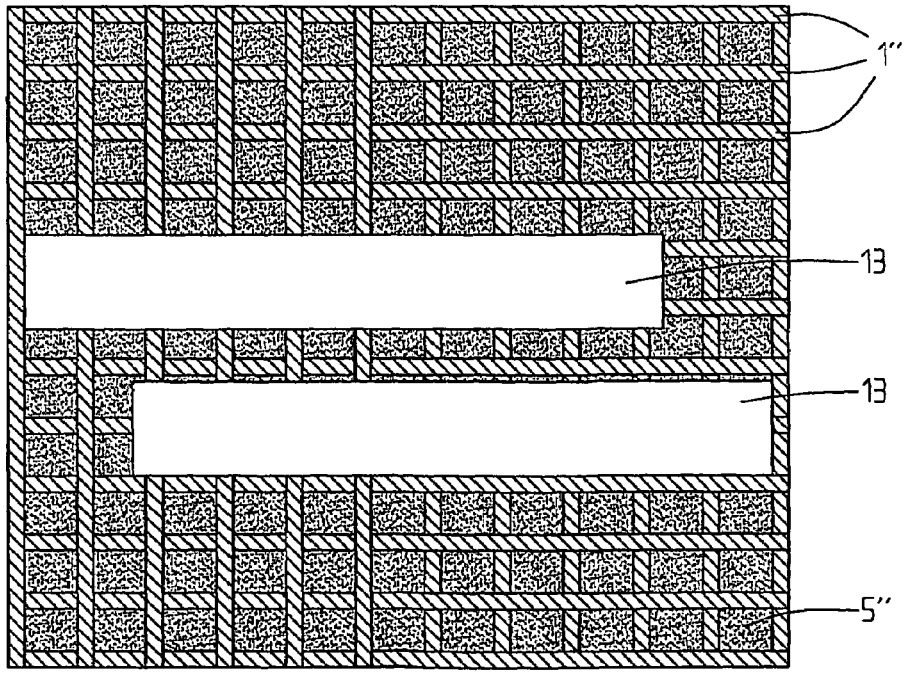
FIG. 3 is a plan view of still another embodiment wherein the microwave device comprises coupled microstrip lines.

FIG. 3 shows a plan of view of a microwave arrangement 30 comprising a microwave device in the form of coupled microstrip lines 13, 13 provided on a dielectricum (not shown) which is disposed on a tunable ground plane as in FIG. 1, of which only the patterned first metal layer 1" is shown. The ground plane is disposed on a Si (here) substrate layer 5". The arrangement 30 may e.g. form part of tunable bandpass filter. Tuning is achieved in accordance with FIG. 1.

Figure 4:
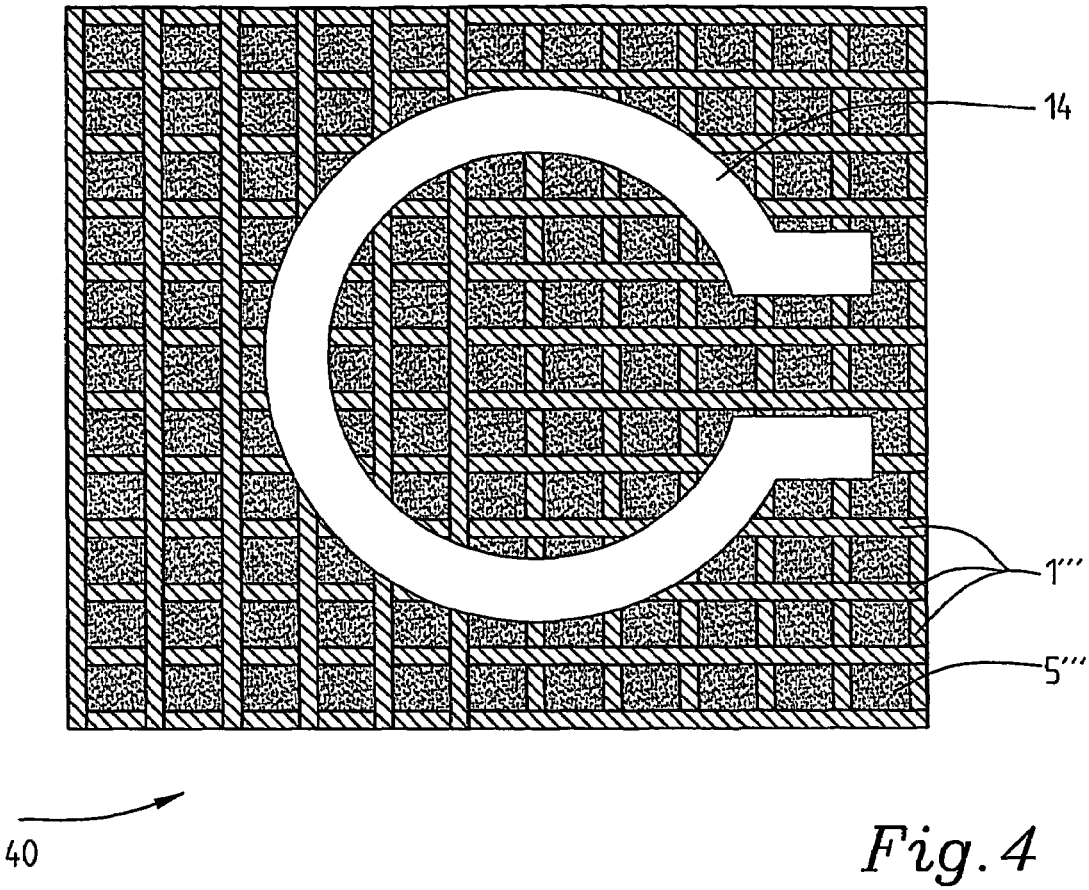
FIG. 4 is a plan view of still another embodiment wherein the microwave device comprises a tunable inductor coil.

FIG. 4 is a plan view of an alternate microwave arrangement 40 comprising a microwave/integrated circuit device in the form of a lumped inductor coil 14 disposed on a dielectricum (not shown) disposed between the inductor coil 14 and a tunable ground plane according to the invention (cf. FIG. 1) of which only the first, patterned (2D EBG) metal layer 1''' is shown. The ground plane is provided on a substrate 5'''. The functioning is similar to that described with reference to FIG. 1 and through applying of a DC voltage to the first and second metal layers, the surface of the ground plane will be tuned and thus the inductance of the inductor coil 14 will be tuned.

Figure 5:
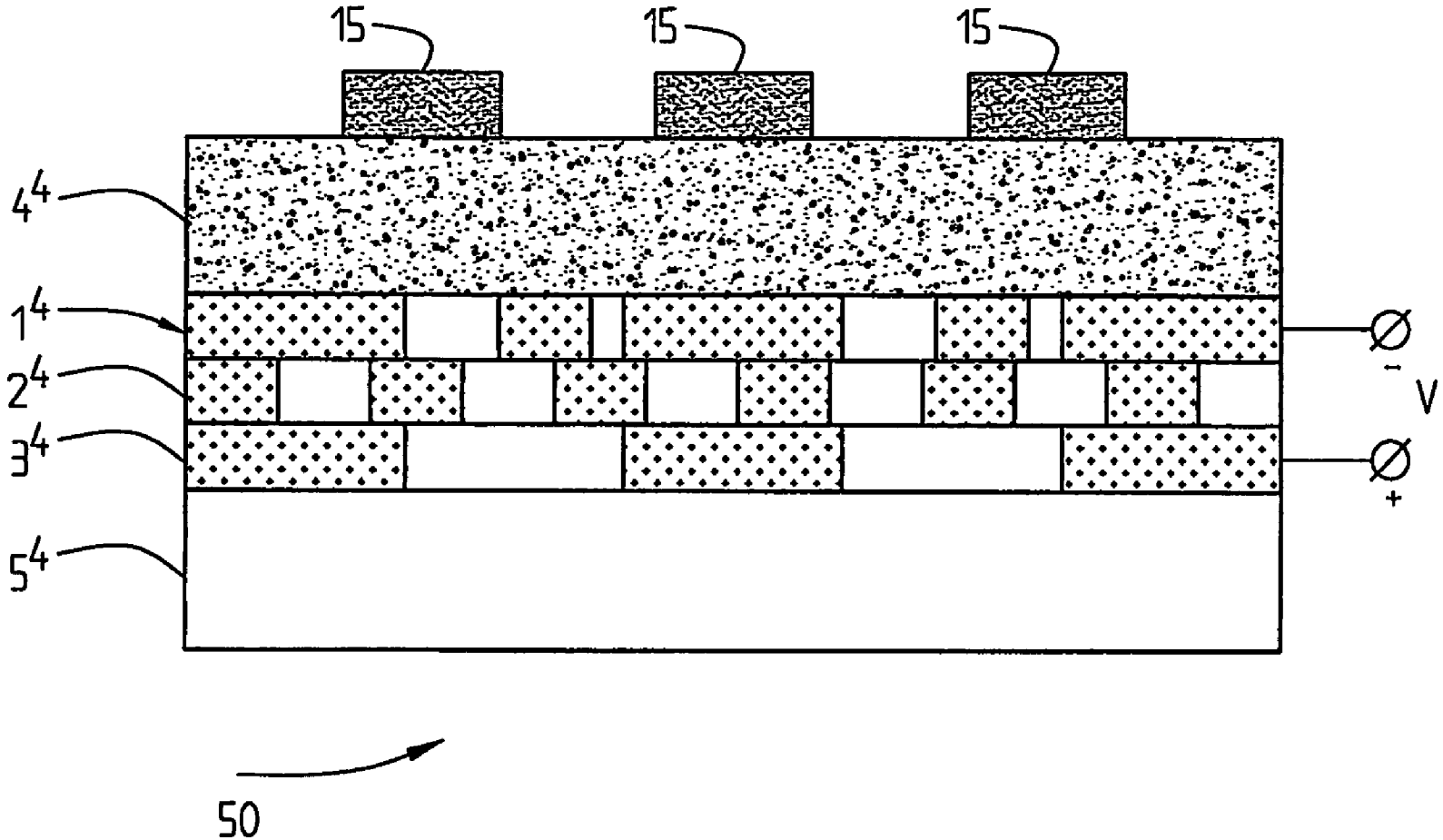
FIG. 5 is a cross-sectional view of an arrangement according to the invention according to still another embodiment.

FIG. 5 is a view in cross-section of a microwave arrangement 50. The microwave device comprises coupled microstrips 15, 15, 15 disposed on a dielectricum $\mathbf{4}^4$. The dielectricum $\mathbf{4}^4$ is arranged on a ground plane which here comprises, on top, a patterned first metal layer $\mathbf{1}^4$, a ferroelectric film layer $\mathbf{2}^4$, which in this embodiment also is patterned, and which in turn is arranged on a second metal layer $\mathbf{3}^4$, which in this particular embodiment also is patterned. The ground plane is provided on a substrate $\mathbf{5}^4$. Tuning is achieved through application of a tuning voltage V to the first and second metal layers.

Figure 6:
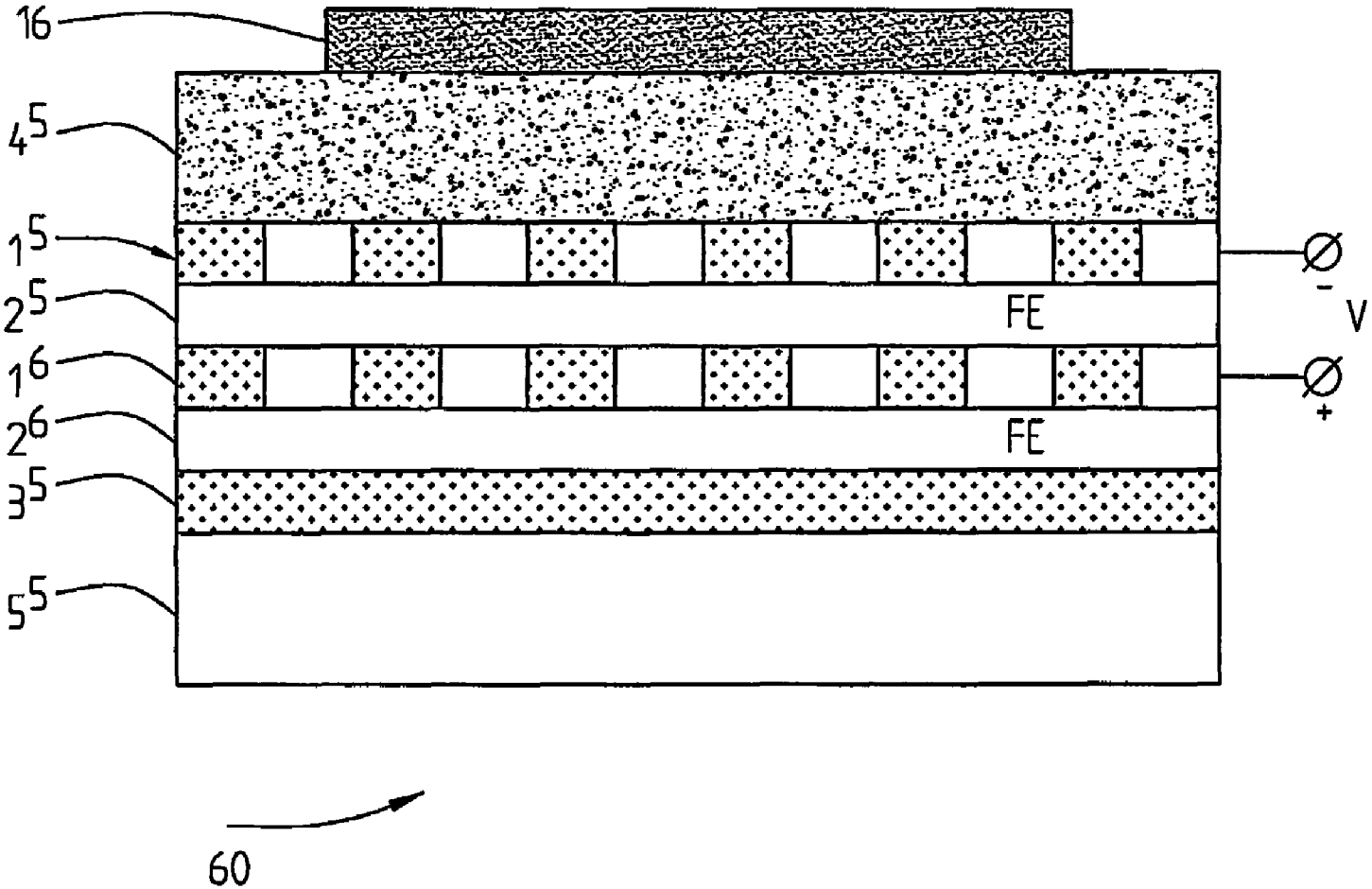
FIG. 6 shows an arrangement according to the invention wherein the ground plane comprises a multilayer structure wherein first and second layers are selected for tuning purposes.

Finally FIG. 6 is a cross-sectional view of still another inventive arrangement 60. It comprises here a patch resonator 16 provided on a dielectricum $\mathbf{4}^5$. However, the ground plane here comprises, in turn from the top, a patterned first metal layer $\mathbf{1}^5$, a ferroelectric layer $\mathbf{2}^5$, another patterned first metal layer $\mathbf{1}^6$, a further ferroelectric layer $\mathbf{2}^6$ and a second metal layer $\mathbf{3}^5$. The layered structure is disposed on a substrate $\mathbf{5}^5$. In the shown embodiment the tuning voltage is applied to the top first metal layer $\mathbf{1}^5$ and the the second metal layer $\mathbf{3}^5$. It could however also have been applied to the first metal layer $\mathbf{1}^6$ and the second metal layer $\mathbf{3}^5$, or to the first metal layer $\mathbf{1}^5$ and the other first metal layer $\mathbf{1}^6$. Any variation is in principle possible. There might also be still more first and second metal layers, and ferroelectric layers.

It should be clear that the invention of course not is limited to the specifically illustrated embodiments, but that it can be varied in a number of ways within the scope of the appended claims.

The invention claimed is:

1. A tunable microwave arrangement, comprising: a microwave circuit device, a substrate, and a layered ground plane structure disposed between the microwave circuit device and the substrate, wherein the layered ground plane structure comprises a plurality of patterned first metal layers, a plurality of second metal layers, and a plurality of tunable ferroelectric film layers between the plurality of patterned first metal layers and the plurality of second metal layers; and the layered ground plane structure comprises a multilayer structure having more than one ferroelectric film layer, each ferroelectric film layer being disposed between respective first and second metal layers.

2. The tunable microwave arrangement of claim 1, wherein the plurality of patterned first metal layers comprises a patterned electromagnetic band gap crystal structure.

3. The tunable microwave arrangement of claim 1, wherein the plurality of tunable ferroelectric film layers is patterned.

4. The tunable microwave arrangement of claim 1, wherein the plurality of ferroelectric film layers is not patterned.

5. The tunable microwave arrangement of claim 1, wherein the plurality of second metal layers is not patterned.

6. The tunable microwave arrangement of claim 1, wherein the plurality of second metal layers is patterned.

7. The tunable microwave arrangement of claim 1, wherein the plurality of second metal layers comprises platinum, copper, silver, or gold.

8. The tunable microwave arrangement of claim 1, wherein the plurality of tunable ferroelectric film layers comprises strontium titanate (SrTiO3) or barium strontium titanate (BaxSrl_xTiO3).

9. The arrangement of claim 1, wherein the layered ground plane structure is tunable in response to a DC voltage applied between the plurality of patterned first metal layers and the plurality of second metal layers.

10. The arrangement of claim 9 wherein tuning the layered ground plane structure tunes the microwave circuit device without decoupling circuits on the microwave circuit device.

11. The arrangement of claim 9, wherein the applied DC voltage affects a dielectric constant of the plurality of patterned first metal layers, thereby changing an impedance of a surface of the layered ground plane structure adjacent the microwave circuit device.

12. The arrangement of claim 1, wherein the microwave circuit device comprises at least one microstrip line.

13. The arrangement of claim 1, wherein the microwave circuit device comprises a patch resonator.

14. The arrangement of claim 1, wherein the microwave circuit device comprises an inductor coil.

15. The arrangement of claim 1, wherein the microwave circuit device comprises a microwave transmission line.

16. The arrangement of claim 1, wherein the microwave circuit device comprises a coplanar strip line device.

17. The arrangement of claim 1, wherein the substrate comprises a semiconductor, a dielectric, or a metal.

18. The arrangement of claim 1, wherein a dielectric having low permittivity and low loss is disposed between the microwave circuit device and a top patterned first metal layer of the layered ground plane structure.

19. The arrangement of claim 18, wherein the dielectric comprises a benzocyclobutene (BCB) or other polymer.

20. The arrangement of claim 9, wherein the applied DC voltage is less than about 100 volts.

21. The arrangement of claim 20, wherein the applied DC voltage is less than about 10 volts.

22. The arrangement of claim 1, wherein the plurality of tunable ferroelectric film layers has a thickness of about 1-2 micrometers.

23. The arrangement of claim 1, wherein the microwave circuit device comprises a semiconductor integrated circuit.

24. A method of tuning a microwave arrangement comprising a microwave circuit device, a substrate, and a layered ground plane structure disposed between the microwave circuit device and the substrate, the method comprising the steps of applying a DC tuning voltage between a first patterned metal layer and a second metal layer, wherein the layered ground plane structure is a multilayered ground plane structure comprising more than two ferroelectric film layers, and selecting any of the first and second metal layers surrounding any of the ferroelectric films for tuning the microwave/integrated circuit device.

* * * * *

UNITED STATES PATENT AND TRADEMARK OFFICE

CERTIFICATE OF CORRECTION

PATENT NO. : 7,573,358 B2
APPLICATION NO. : 10/596687
DATED : August 11, 2009
INVENTOR(S) : Gevorgian et al.

It is certified that error appears in the above-identified patent and that said Letters Patent is hereby corrected as shown below:

In Column 1, Line 38, delete "refector" and insert -- reflector --, therefor.

In Column 1, Line 39, delete "elecrically" and insert -- electrically --, therefor.

In Column 1, Line 42, delete "sective" and insert -- selective --, therefor.

In Column 1, Line 52, delete "wavelenght" and insert -- wavelength --, therefor.

In Column 2, Line 34, delete "Elecromagnetic" and insert -- Electromagnetic --, therefor.

In Column 2, Lines 34-35, delete "ferroelctric" and insert -- ferroelectric --, therefor.

In Column 3, Line 52, delete "reonator," and insert -- resonator, --, therefor.

In Column 5, Line 31, delete "the the" and insert -- the --, therefor.

In Column 6, Line 8, in Claim 8, delete "(SrTiO3)" and insert -- ($SrTiO_3$) --, therefor.

In Column 6, Line 9, in Claim 8, delete "(BaxSrl_xTiO3)." and insert -- ($Ba_xSr_{1-x}TiO_3$). --, therefor.

Signed and Sealed this

Nineteenth Day of January, 2010

David J. Kappos

David J. Kappos
*Director of the United States Patent and Trademark Office*